US005853115A

United States Patent [19]

Turbett et al.

[11] Patent Number: 5,853,115

[45] Date of Patent: Dec. 29, 1998

[54] DISPENSING CLOSURE

[75] Inventors: James Lynn Turbett, Stamford, Conn.; Mark John Iaia, Valley Cottage, N.Y.

[73] Assignee: Chesebrough-Pond's USA Co., Division of Conopco, Inc., Greenwich, Conn.

[21] Appl. No.: 773,807

[22] Filed: Dec. 18, 1996

[51] Int. Cl.[6] ..... B67D 3/00

[52] U.S. Cl. ..... 222/531; 222/534

[58] Field of Search ..... 222/531, 534, 222/536

[56] References Cited

U.S. PATENT DOCUMENTS

| | | | |
|---|---|---|---|
| 3,430,825 | 3/1969 | Wilson | 222/534 |
| 3,618,829 | 11/1971 | Elmore et al. | 222/531 X |
| 3,884,392 | 5/1975 | Hazard | 222/534 X |
| 4,081,108 | 3/1978 | Wilson et al. | 222/536 X |
| 4,209,114 | 6/1980 | Wilson et al. | 222/536 |
| 4,219,138 | 8/1980 | Hazard | 222/534 |
| 4,271,984 | 6/1981 | Ducros et al. | 222/536 X |
| 4,282,991 | 8/1981 | Hazard | 222/531 |
| 4,519,529 | 5/1985 | Seltz | 222/536 X |
| 4,756,451 | 7/1988 | Wilson | 222/534 |
| 4,776,475 | 10/1988 | La Vange | 222/153 X |
| 4,819,832 | 4/1989 | Lawson | 222/534 X |
| 5,022,566 | 6/1991 | Song et al. | 222/534 X |
| 5,190,176 | 3/1993 | Lavange | 222/534 X |
| 5,356,044 | 10/1994 | La Vange | 222/536 X |
| 5,370,284 | 12/1994 | Dirksing | 222/534 |
| 5,477,994 | 12/1995 | Feer et al. | 222/531 X |
| 5,484,089 | 1/1996 | Picerno | 222/534 |
| 5,503,309 | 4/1996 | Oder et al. | 222/534 |
| 5,709,318 | 1/1998 | Oder | 222/536 X |

*Primary Examiner*—Kenneth Bomberg
*Attorney, Agent, or Firm*—Milton L. Honig

[57] ABSTRACT

A dispensing closure for a container is provided having a cap, a receiving cavity on an outer wall of the cap and a spout rotatably lodged within the cavity. Product from the container can exit through the cap and be dispensed through a channel in the spout when the latter is rotated to a dispensing position. The spout is formed with a pair of flanking wings each having a trunnion/bearing mechanism on an outer surface. The wings are inwardly but not outwardly flexible thereby allowing the spout to be readily snapped into the cavity of the cap during manufacturing assembly

9 Claims, 3 Drawing Sheets

DISPENSING CLOSURE

BACKGROUND OF THE INVENTION

1. Field of the Invention

The invention concerns a dispensing closure having a cap with a spout pivotally mounted therein.

2. The Related Art

Closures with rotatable spouts possess a rich history. Advances in this art have been well documented in the patent literature. For instance, U.S. Pat. No. 4,271,984 (Ducros et al.) describes a pivoting spout for communicating between two different compartments of a container. Two pasty substances are thereby deliverable in adjustable proportions. Not only pasty substances but also pills as disclosed in U.S. Pat. No. 5,484,089 (Picerno) can be dispensed through a spout closure.

U.S. Pat. No. 4,209,114 (Wilson et al.) describes a solution to the problem of assembling a rotatable nozzle to its cap. The invention provides for trunnions being snap fitted into complementary trunnions by shaping the bearings and trunnions to both have surfaces of revolution decreasing in diameter with the distance from the portion of the movable part fitting within and between the spaced trunnions. The bearing entrances must be decreased in width in a corresponding manner. Although this invention has provided a significant advance in assembly, better technology is still necessary.

Product leakage and drooling have been further problems. U.S. Pat. No. 4,219,138 (Hazard) focuses on the problem by employing a washer spring around an opening of the cap against which the spout is seated. By this arrangement the closure is resiliently biased at a sealing surface. Leakage is well prevented. However, residual product remains within the channel of the spout which often leads to some drooling of product after completion of dispensing.

Accordingly, it is an object of the present invention to provide a closure with a rotatable spout that can be readily snapped into its cavity rendering assembly much easier.

Another object of the present invention is to provide a cap with a pivotal spout that avoids drooling of residual product remaining in the spout after completion of dispensing.

These and other objects of the present invention will become more readily apparent from consideration of the following summary and detailed description.

SUMMARY OF THE INVENTION

A dispensing closure for a container is provided including:

a cap including a mechanism adapted to secure the cap to the container, a passageway within the cap communicating with product inside the container, a cavity traversing at least one outer surface of the cap; and a spout rotatably lodged within at least a portion of the cavity, the spout including an elongate nozzle internally traversed by a channel having an inlet and an outlet opening at opposite ends thereof, the inlet opening capable of communicating with the cap passageway, a trunnion/bearing mechanism formed on opposite sides of the nozzle engageable with a complementary trunnion/bearing mechanism within the cavity for permitting rotation of the spout, and at least one wing flanking and inwardly flexible toward the nozzle with an outer surface fitted with one of the trunnion/bearing mechanisms.

Ordinarily there will be a pair of wings flanking the nozzle on either side. Each of the wings will laterally be inwardly but not outwardly flexible. Most preferred is where each of the wings includes a trunnion. Along at least one section of the trunnion may be a bevel.

In another aspect of the invention, the channel traversing the nozzle may include a first and second portion. The first portion, adjacent the outlet opening, is oriented at an angle to the second portion, the latter being adjacent the inlet opening. Furthermore, the outlet opening may include an obstacle structure for disrupting product flow. An embodiment of the obstacle structure can be a plurality of windows. These windows may even be formed by a series of parallel channels within the nozzle separated by a septum wall.

BRIEF DESCRIPTION OF THE DRAWING

The above objects, features and advantages of the present invention will become more readily understood in connection with the detailed description of preferred embodiments, when considered with the accompanying drawing in which.

DETAILED DESCRIPTION OF THE INVENTION

Figure 1:
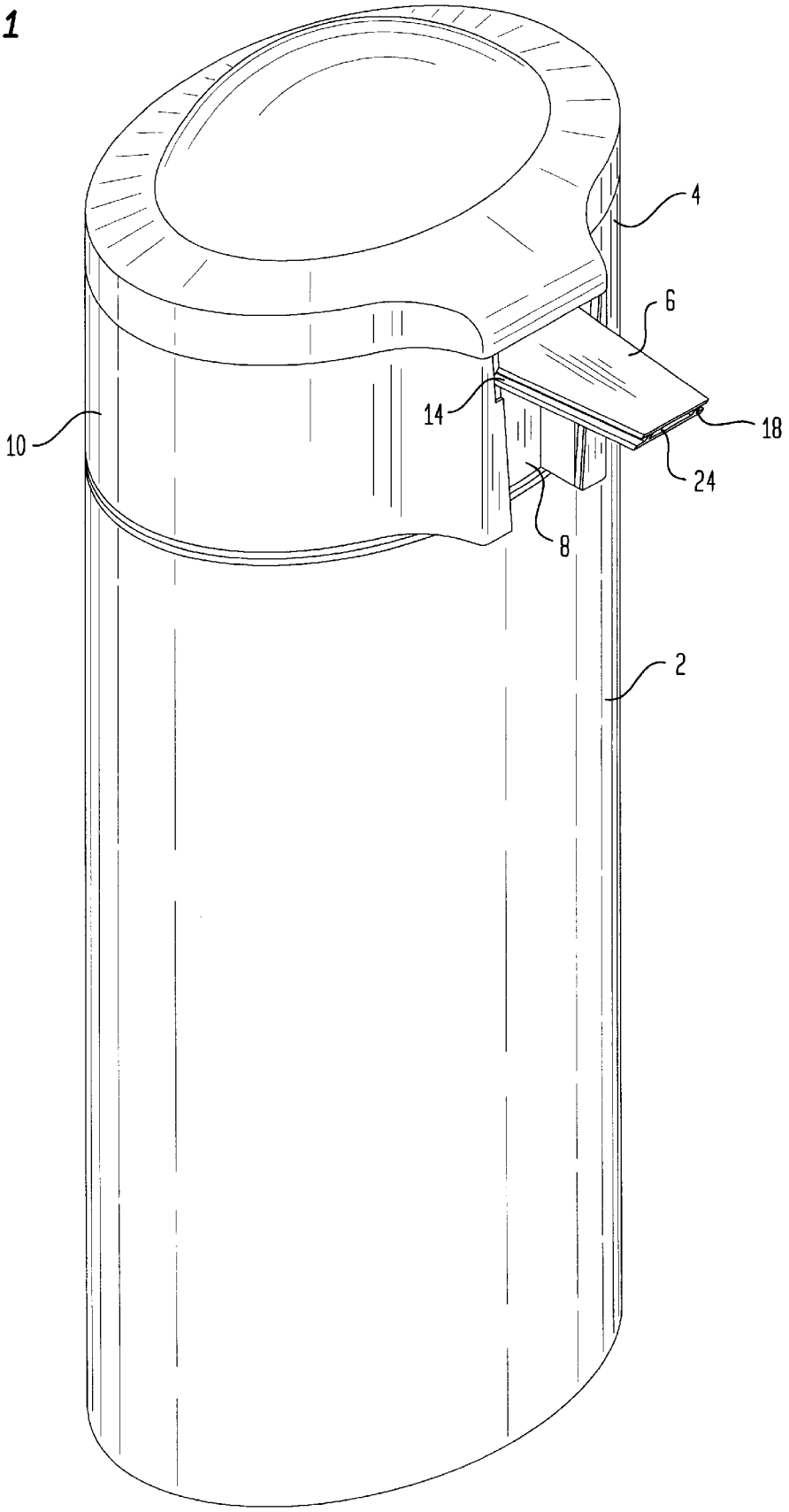
FIG. 1 is a front elevational view of a container utilizing the dispensing closure of the present invention.

Dispensing closures of the present invention are illustrated in FIG. 1 as part of a container 2 and a cap body 4. The cap body includes a spout 6 pivotal from an open dispensing position to a closed position, the latter orienting the spout downwards to rest within recess cavity 8 along an apron 10 of the cap body.

Figure 2:
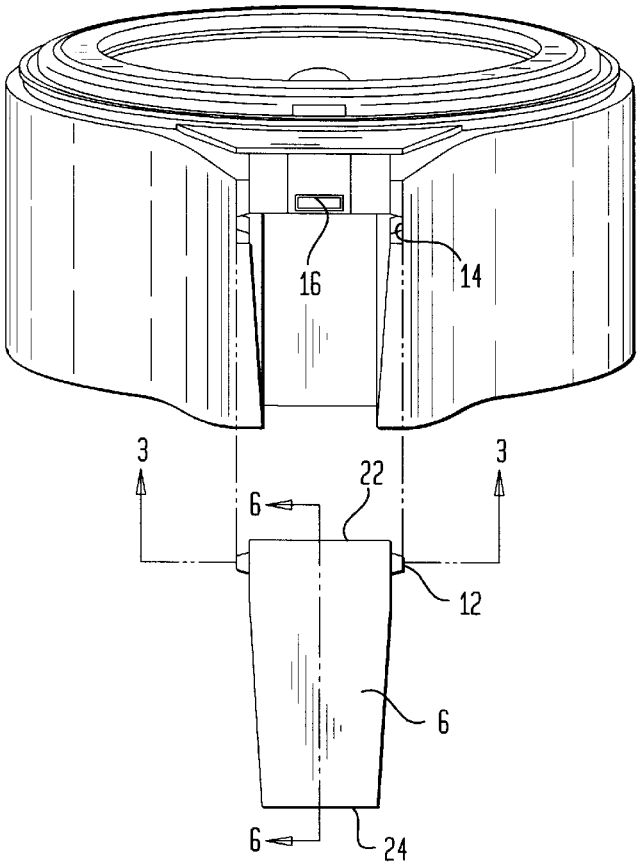
FIG. 2 is a cap over the container with a recess cavity for receiving the pivoting spout.

FIG. 2 illustrates the spout 6 in a separated view from the cap body 4. Spout 6 is rotatably lodged within the recess cavity. Pivotal rotation of the spout is effected through rotation of trunnion 12 in respective bearings 14 complementarily positioned within the recess cavity. A passageway 16 is formed in the recess cavity with an exit opening positioned between the bearings 14.

The spout includes an elongate nozzle 18 internally traversed by a channel 20 having an inlet opening 22 and an outlet opening 24 at opposite ends of the nozzle. Inlet opening 22 is capable of communicating with the passageway 16 thereby allowing product in the container to flow outward for dispensing at the outlet opening 24.

Figure 3:
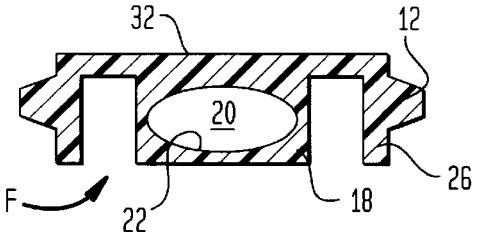
FIG. 3 is an end view of the spout taken along 3—3 of FIG. 2.
Figure 4:
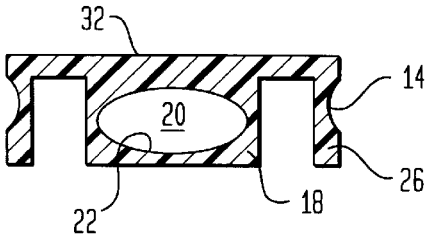
FIG. 4 is an end view similar to that of FIG. 3 except illustrating a second embodiment wherein the wings are fitted with bearings rather than trunnions.

FIG. 3 best illustrates a pair of wings 26 flanking the nozzle 18, with an outer surface of each wing including a trunnion 12. Each of the wings are inwardly flexible along the direction of arrow F toward the nozzle but are rigid with respect to outward flexing away from the nozzle. As a consequence of this unidirectional flexibility, the spout can readily be snapped into the recess cavity to connect trunnion and bearing. FIG. 4 is identical to FIG. 3 except for bearings 14 replacing trunnions 12 on each of the wings.

Figure 7:
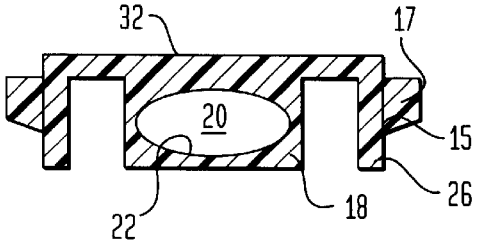
FIG. 7 is an end view similar to that of FIG. 3 except illustrating a third embodiment wherein the wings are fitted with trunnion truncated on their lower half.
Figure 8:
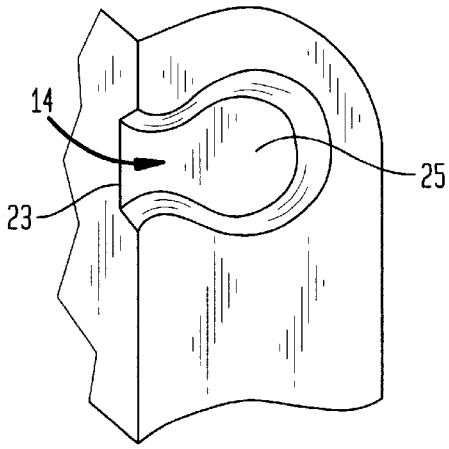
FIG. 8 is a front view of a bearing to carry the trunnions on the spout of the first embodiment shown in FIG. 3.
Figure 9:
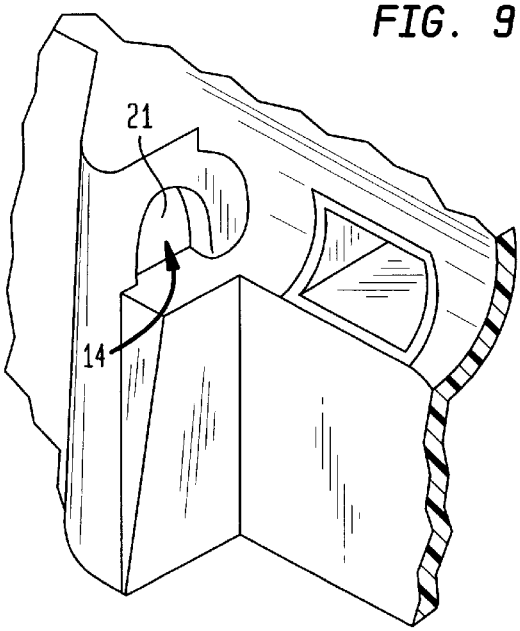
FIG. 9 is a front view of a bearing to carry the trunnions on the spout of the third embodiment shown in FIG. 7.

FIG. 7 illustrates a third embodiment of the wings wherein the trunnions 15 on a lower side 17 are tapered to assist their insertion into the bearings of the cap. FIG. 9 illustrates bearings 14 having a hollow well 21. The well defining the bearing is molded by corring the cap from its bottom edge. This arrangement contrasts with FIG. 8 illustrating a bearing with an open side 23 which allows the trunnion of FIG. 3 to laterally enter recess 25.

Figure 5:
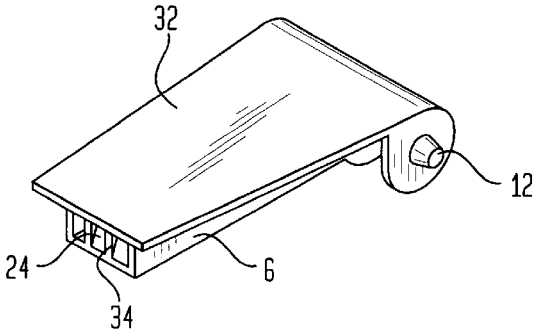
FIG. 5 is a perspective view of the spout illustrating the outlet opening with obstacle mechanism.
Figure 6:
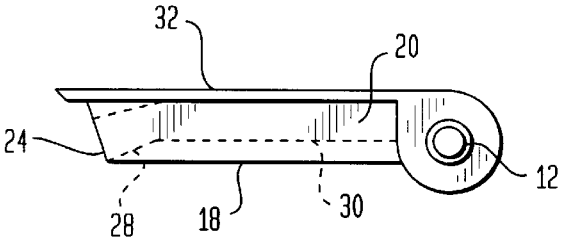
FIG. 6 is a cross sectional view taken along line 6—6 of FIG. 2.

Another aspect of the invention is best illustrated by the cross sectional view shown in FIG. 6. Channel 20 includes a first portion 28 adjacent to outlet opening 24 and a second portion 30 adjacent to inlet opening 22. The first portion is oriented downwardly relative to nozzle top surface 32 and angled relative to the second portion 30. The downward angling or taper insures a more accurate downward dispensing of product. Insurance against dripping can be provided by a feature shown in FIG. 5. A pair of posts 34 are vertically positioned across the outlet opening 24. These posts serve to break up any remnant drop near the outlet opening when dispensing has been completed.

The foregoing description and drawing represent at least two embodiments of the present invention but are not intended as limitations of the scope thereof, it being understood that the invention can be practiced through obvious modifications and rearrangements without departing from its essential spirit.

What is claimed is:

1. A dispensing closure for a container comprising:

a cap including a means adapted to secure the cap to the container, a passageway within the cap communicating with product inside the container, a cavity traversing at least one outer surface of the cap; and a spout rotatably lodged within at least a portion of the cavity, the spout including an elongate nozzle internally traversed by a channel having an inlet and an outlet opening at opposite ends thereof, the channel including a first and second portion, the first portion being adjacent to the outlet opening and oriented at an angle to the second portion, the inlet opening capable of communicating with the cap passageway, a trunnion/bearing means formed on opposite sides of the nozzle engageable with a complementary trunnion/bearing means within the cavity for permitting rotation of the spout, and at least one wing flanking and inwardly flexible toward the nozzle with an outer surface fitted with one of the trunnion/bearing means.

2. The closure according to claim 1 wherein the bearing is open only on a front face thereof.

3. The closure according to claim 1 wherein the outlet opening includes an obstacle means for disrupting product flow.

4. The closure according to claim 3 wherein the obstacle means is a plurality of windows.

5. The closure according to claim 1 wherein the at least one wing is laterally inwardly but not outwardly flexible.

6. The closure according to claim 5 wherein there are two wings each flanking an opposite side of the nozzle.

7. The closure according to claim 6 wherein the trunnion/bearing means formed on the wing is structured as a trunnion.

8. The closure according to claim 7 wherein the trunnion has a bevelled edge.

9. The closure according to claim 1 wherein the bearing is a hollow recess open on a front and a side face thereof.

* * * * *